US011332673B2

(12) United States Patent
Schons et al.

(10) Patent No.: US 11,332,673 B2
(45) Date of Patent: May 17, 2022

(54) METHOD OF CHARGING A COKE OVEN

(71) Applicant: PAUL WURTH S.A., Luxembourg (LU)

(72) Inventors: Stefan Schons, Tawern (DE); Patrick Hutmacher, Bettembourg (LU); Paul Tockert, Berbourg (LU)

(73) Assignee: PAUL WURTH S.A., Luxembourg (LU)

( * ) Notice: Subject to any disclaimer, the term of this patent is extended or adjusted under 35 U.S.C. 154(b) by 20 days.

(21) Appl. No.: 16/482,708

(22) PCT Filed: Feb. 2, 2018

(86) PCT No.: PCT/EP2018/052700

§ 371 (c)(1),
(2) Date: Jul. 31, 2019

(87) PCT Pub. No.: WO2018/141926

PCT Pub. Date: Aug. 9, 2018

(65) Prior Publication Data

US 2020/0002617 A1 Jan. 2, 2020

(30) Foreign Application Priority Data

Feb. 2, 2017 (LU) ..... 100063

(51) Int. Cl.
*C10B 37/02* (2006.01)
*B65D 88/70* (2006.01)
(Continued)

(52) U.S. Cl.
CPC ..... *C10B 37/02* (2013.01); *B65D 88/703* (2013.01); *C10B 31/02* (2013.01); *C10B 45/005* (2013.01)

(58) Field of Classification Search
CPC ..... C10B 37/00; C10B 37/02; C10B 37/06; C10B 37/04; C10B 31/00; C10B 31/04;
(Continued)

(56) References Cited

U.S. PATENT DOCUMENTS 2,234,825 A 3/1941 Koppers
3,366,282 A * 1/1968 Lucas ..... B65D 88/70 222/195
4,058,230 A 11/1977 Bellenberg et al.

FOREIGN PATENT DOCUMENTS

CN 1607236 A 4/2005
CN 101792675 A 8/2010
(Continued)

OTHER PUBLICATIONS

International Search Report dated May 22, 2018 re: Application No. PCT/EP2018052700, pp. 1-5, citing: JP H11 349953 A, DE 69 29 049 U, CN 201 643 487 U and US 2 234 825 A.
(Continued)

*Primary Examiner* — Jonathan Luke Pilcher
(74) *Attorney, Agent, or Firm* — Cantor Colburn LLP

(57) ABSTRACT

A method of charging a coke oven with coal includes the steps of charging coal in a coke oven chamber, whereby a heap of coal forms in the chamber; and leveling the heap of coal, where the leveling step includes: introducing a blasting end of a blasting pipe into the heap of coal, the blasting pipe being in communication with a pressurized gas storage vessel configured to release gas blasts; releasing at least one gas blast through the blasting end in the heap of coal in order to cause a leveling thereof; removing the blasting pipe from the chamber.

12 Claims, 3 Drawing Sheets

(51) Int. Cl.
*C10B 31/02* (2006.01)
*C10B 45/00* (2006.01)

(58) Field of Classification Search
CPC .... B65D 88/70; B65D 88/703; B65D 88/706; F27D 2003/168; F27D 2003/169
See application file for complete search history.

(56) References Cited

FOREIGN PATENT DOCUMENTS

| | | | |
|---|---|---|---|
| CN | 201643487 | U | 11/2010 |
| CN | 102030311 | A | 4/2011 |
| CN | 106147801 | A | 11/2016 |
| DE | 6929049 | U | 7/1971 |
| GB | 362783 | A | 12/1931 |
| JP | H11349953 | A | 12/1999 |
| KR | 20140040993 | A | 4/2014 |

OTHER PUBLICATIONS

Writte Opinion dated May 22, 2018 re: Application No. PCT/EP2018052700, pp. 1-7, citing: JP H11 349953 A, DE 69 29 049 U, CN 201 643 487 U and US 2 234 825 A.
CN Search Report dated Nov. 18, 2020 re: Application No. 2018800096119, pp. 1-2, citing: CN101792675A, CN106147801A, CN1607236A, CN102030311A, U.S. Pat. No. 4,058,230A and KR20140040993A.

* cited by examiner

METHOD OF CHARGING A COKE OVEN

TECHNICAL FIELD

The present disclosure generally relates to the field of coke manufacturing. In particular, the present disclosure relates to a method of charging a coke oven.

BACKGROUND

As it is well known, modern cokemaking plants are constructed in batteries that may contain from as few as ten to over 100 coke ovens chambers. Because of the physical dimensions of the coking chambers (narrow, long and tall) they sometimes are referred to as slot ovens. The ovens are designed and operated to permit collection of the volatile products evolved from coal during the coking process.

The coking process is typically operated in a cyclic manner, repeating the following main steps: charging; coking; and pushing (emptying). The coal is charged into the coking chamber through charging holes provided in the roof of the oven. The coke ovens are designed to take a definite volume of coal per charge, and are charged from a larry car operating between overhead coal storage bins and the ovens on a track supplied by the battery top. Since coal is charged from charging holes in the roof, a conical heap of coal (peaked pile) forms under each charging hole, resulting in an uneven surface structure of the carbon bed in the coke oven chamber.

Therefore, the charging step includes a leveling operation, during which a lever—generally on the pusher side—is used to level the coal bed. The function of the lever is to level the coal charge in the oven, leaving a free gas space below the roof of the charged oven. The leveler includes an electrically operated leveling bar that is introduced into the oven by a leveling door at the top of the oven door on the pusher side. The leveling bar is moved back and forth across the peaked coal piles, thereby leveling the peaks of coal beneath the charging holes into the valleys. As a result, a substantially flat upper surface of the coal bed is obtained. The bar is then withdrawn from the oven, the leveling door and charging holes are closed, and the coking operation begins.

GB362783A, for example, describes such a leveler bar and leveling operation to distribute conical heaps of coal formed during charging of slot ovens.

It should be noticed that excessive leveling of the charged coal not only extends the time during which the leveler door is opened, but also tends to pack the coal at the top of the charge, particularly under the charging holes, and may cause localized erosion of the oven wall.

Nevertheless, improvements in larry cars, particularly the method of discharging coal, have been directed toward making possible better charging practices. The aim have been, inter alia, to reduce the charging time; to prevent hanging up of the coal in the larry hoppers; and to reduce the number of passes of the leveling bar necessary for leveling.

JP H11 349953 discloses an apparatus for evenly feeding coal in a coke oven. The apparatus proposes using (instead of a leveller bar) a gas jet means in order to level the coal. The apparatus comprises a nozzle 7 that is lowered by a lifting device 9 into the coke oven through an insertion hole 5. The nozzle 7 permits blowing a flow of air onto or into the coal in order to effect levelling. A flow adjusting device 12 is provided between the air blower 15 and the nozzle 7.

DE 69 29 049 U discloses a charging car for a coke oven. The car comprises a device for supplying a flow of pressurized gas in the direction of the charge hole.

CN 201 643 487 discloses a multifunctional spontaneous combustion treating device for a coal storage yard using a gas blaster system and intended to be mounted on coke pushing means. The device is configured to emit air blasts inside the coal in order to extinguish a fire occurring at the time of coke pushing, i.e. at the end of the coke distillation process.

BRIEF SUMMARY

The disclosure provides an improved method of charging a coke oven that includes a leveling operation, which is efficient and easy to implement.

According to the present disclosure, a method for charging a coke oven with coal comprises the steps of: a) charging coal in a coke oven chamber, whereby a heap of coal forms in the chamber; and b) leveling the heap of coal.

It shall be appreciated that the leveling step b) comprises:

introducing a blasting end of a blasting pipe into the heap of coal, the blasting pipe being in communication with a pressurized gas storage vessel configured to release gas blasts (i.e. forming a gas blaster);

releasing at least one gas blast through the blasting end in the heap of coal in order to cause a leveling thereof;

removing the blasting pipe from the chamber.

The present disclosure provides a leveling operation that does no longer use a conventional leveling bar but exploits gas blasts emitted by a gas blaster. In other words, the leveling is no longer based on a lever device that is moved across the chamber, but on the impact force and amount of air volume of the gas blast (forming an explosive spread of air) that causes the peaked piles of coal to collapse, achieving leveling of the heap of coal. Gas blasters, such as air blasters and air cannons, are well known in the art.

Gas blasters are simple and reliable devices consisting of a storage vessel filled with pressurized gas that comprises a rapid release valve with trigger mechanism that is configured to quickly release said volume of gas via a blow-out pipe, thus creating a gas blast. Any appropriate type of gas blaster can be used in the present method. The method can thus be easily implemented using know technology, with simple adaptations.

By combining a conventional gas blaster (or air cannon) with a blasting pipe of appropriate length, the method can be conveniently implemented by introducing the blasting pipe into the coke oven chamber by means of a vertical or oblique descending movement through an aperture in the roof of the coke oven, in particular through the charging hole (through which coal is inserted). The blasting pipe can be connected directly or indirectly (i.e. via intermediate piping) with the storage vessel.

Upon charging, the heap of coal in the coke oven chamber comprises at least one conical heap (typically one below each charging hole). The blasting pipe is preferably plunged in the heap of coal through the upper surface of a conical heap of coal. In particular, the blasting end of the blasting pipe is positioned in a region underneath the apex of the conical heap, preferably centrally. The leveling step b) is typically carried out for each conical heap in the coke oven chamber.

Preferably, a nozzle is provided at the end of the blasting pipe to define one or more blasting directions. A variety of nozzle configurations may be contemplated.

The present method has been particularly devised for the coking process of coal for use in shaft and blast furnaces. In this context, the coal may be fine coal as conventionally used in the field. In particular, the coal loaded in the coke oven may have a grain size below 10 mm, more particularly below 5 mm. p As will be appreciated, the present method strikingly differs from conventional methods such as disclosed in JP H11 349953, where a continuous flow of compressed air is blown on the coal during charging. The present disclosure relies on the use of a gas blaster, the blasting pipe being introduced into the coking chamber after charging the desired amount of coal therein (and before stating the distillation process), and does not need to be present during the coal loading into the chamber. Also, the principle is different since, as is known, a gas blast forms an impact force, forming a kind of explosive spread of gas/air, that here causes the collapse of the heap of coal. Thus the disclosure exploits the punctual gas blast in the heap of coal after charging, which is different from continuously blowing air onto the coal. The release of a gas blast has a quasi-instantaneous effect on the coal pile, that will be immediately collapse (at least partially) due to this explosive spread. It is thus more efficient than a continuous gas flow and less ressources-consuming (less air and energy for the blower), and does not obstruct the charhing hole during coke charging.

To the knowledge of the inventors, it is the first time that a blasting pipe is introduced through the charging roof of a coke oven, in particular through the charging hole, in order to release gas blast for the purpose of collapsing the coal heaps formed during coal charging.

In embodiments, the coal/coke level may be measured by an appropriate sensor/radar positioned, e.g., nearby charging hole. This allows monitoring the material level and being informed about the height of the gas channel (distance between material and ceiling of the coke oven chamber) for ensure a good gas flow.

According to another aspect, the present disclosure relates to a device for leveling a heap of coal that comprises:

- a storage vessel with pressurized gas configured to selectively release gas blasts;
- a blasting pipe with a connection port and a blasting end, the connection port being axially remote from the blasting end and being in communication with the storage vessel;
- at least one opening at the blasting end of the blasting pipe through which a blast of compressed gas can be released into a heap of coal for leveling the latter;
- a manipulator device configured for moving the blasting pipe between a rest position and a working position, in which the blasting end of the blasting pipe is positioned in the heap of coal.

The present device is adapted for use in the above described method.

Depending on the embodiments, the blasting pipe and storage vessel may be rigidly connected, whereby they are moved together; or there may be an articulation and/or intermediate piping that allows moving the blasting pipe relative to the storage vessel.

Advantageously, the blasting end of the blasting pipe comprises a nozzle with at least one blasting orifice.

In one embodiment, the blasting nozzle extends in the axial direction of the blasting pipe and comprises a unique blasting orifice adapted to release gas blasts axially ahead of the blasting pipe.

In other embodiments, the blasting nozzle comprises a pair of blow tubes each deviating by a predetermined angle from the axis of the blowing pipe for releasing blasts of compressed gas in two different directions, preferably symmetrical with respect to the axis of the blowing pipe. In general, the predetermined deviating angle is comprised between 20° and 90°.

The blasting tubes may be straight tubes and define two blasting directions forming an angle of about 70° or 90°. Alternatively, the blasting tubes comprise curved portions, and the discharge orifices are aligned along opposite blasting directions, in particular forming an angle of 180°.

The nozzle may advantageously comprise a frontal guide, preferably V-shaped, the apex thereof pointing ahead of the first and second blasting nozzles in order to ease the introduction of the blasting pipe into the heap of coal.

Preferably, the device comprises a tightening ring that is configured to cooperate with a charging hole of a coke oven, in order to close said charging hole during blasting.

According to another aspect, the disclosure concerns a coke oven comprising at least one coke oven chamber having a roof; and a device for leveling a heap of coal as disclosed hereinbefore.

The present disclosure provides a number of benefits:

- no further extensive levelling bar technology on pusher car necessary.
- better sealing of coke oven chamber (Entrance door for levelling bar above main door for pusher no more necessary).
- level of coal deeper and equally leveled in comparison to levelling bar technology (coal bed level may be up to 30% lower than with levelling bar).
- no more extensive spillage due to retracted levelling bar outside coke oven chamber.
- increase of coal volume.
- reduction of entire charging cycle-time.
- better gas flow between the roof of the coke oven chamber and the leveled coal bed.
- better permeability of gas of the entire cake due to constant height of coke, leading to higher productivity
- insensitive against high temperature in upper coke oven chamber (compared to levelling bar). Indeed, the blasting tube is introduced in the conical heap of cold coal that rises up to the charging hole; it is thus protected against heat by the heap of coal.
- mechanism for introducing and removing the blasting pipe from the coke oven chamber is simpler compared pusher mechanism.
- Costs are reduced: less efforts in programming, visualisation, cabling; Less drive units and instrumentation; less maintenance.

BRIEF DESCRIPTION OF THE DRAWINGS

Further details and advantages of the present disclosure will be apparent from the following detailed description of several not limiting embodiments with reference to the attached drawings, wherein.

DETAILED DESCRIPTION

Figure 1:
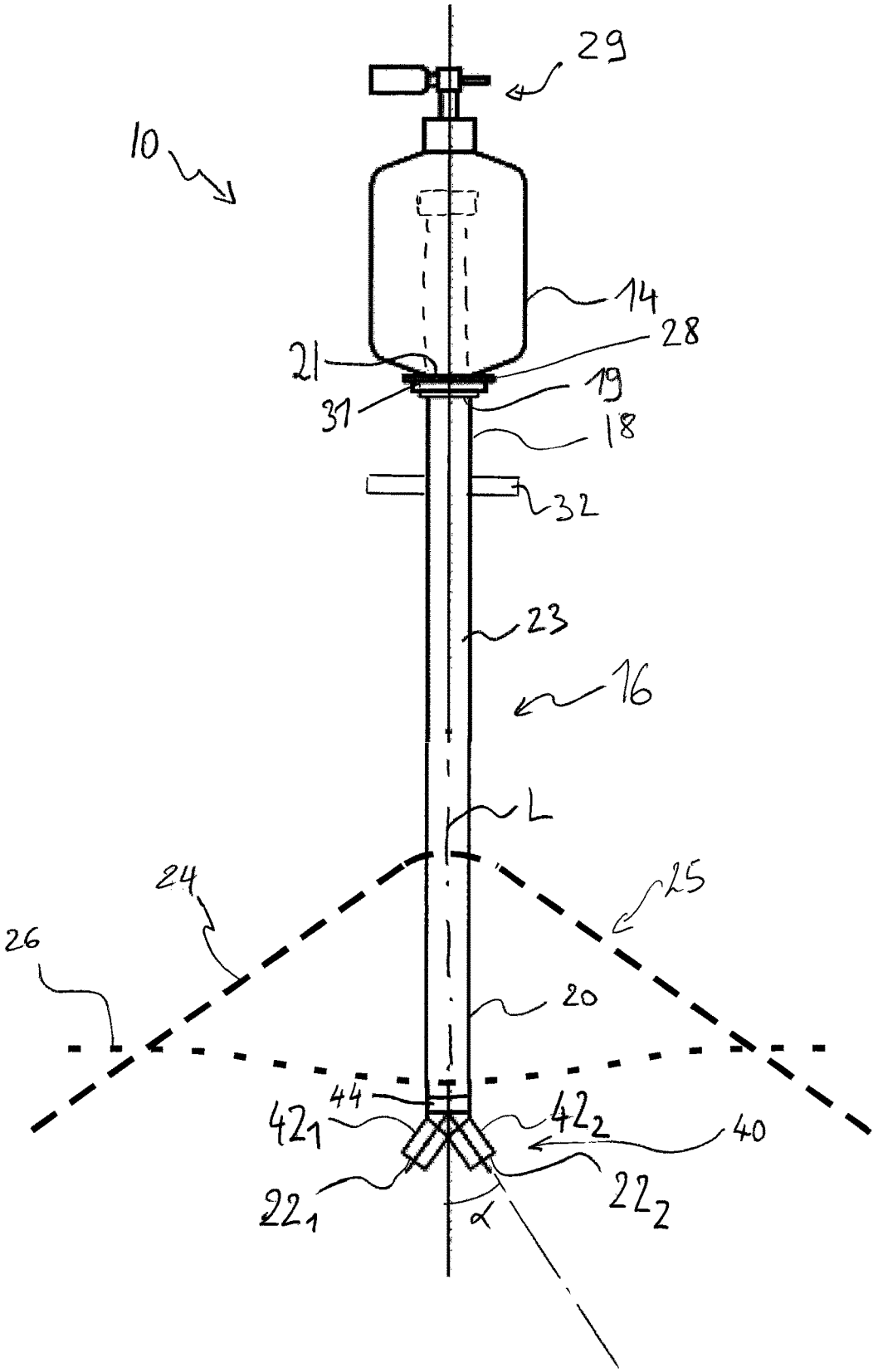
FIG. 1 is a front view of a leveling device according to one embodiment of the present disclosure.

FIG. 1 shows an embodiment of the present device 10 for leveling a heap of coal in a coke oven chamber of a coke oven battery in accordance with the present disclosure. The device 10 will first be described in relation to FIGS. 1 to 4; and the use thereof in the context of the charging of coke ovens will be explained further below with reference to FIGS. 5 to 8. The device 10 mainly comprises a storage vessel 14 for a pressurized gas, preferably air, fluidly connected with a blasting pipe 16, which has a connection end 18 with an inlet port 19 and a blasting end 20. In the embodiment, the blasting pipe 16 is a straight, rigid pipe defining an internal gas passage 23 extending between the inlet port 19 (at one end of the pipe 16) and the blasting end 20, at the axially opposite extremity of the blasting pipe 16. As can be seen, the blasting pipe 16 has its inlet 19 connected to an outlet 21 of the storage vessel 14, whereby both elements are in fluid communication.

At the blasting end 20, air blasts are emitted through one or more openings, here a pair of openings $\mathbf{22}_1$ and $\mathbf{22}_2$.

One can see on FIG. 1 a first dotted line that represents the upper surface 24 of a heap of coal. One will recognize here the shape of a cone. Indeed, as explained in the background art section, when a coke oven is filled with coal, a conical heap forms below each charging hole in the roof, according to the angle of repose of the coal particles. Seen more globally, the global shape of the coal heap in the coke oven is comprised of a base layer of coal, with a plurality of conical heaps (or peaked piles) on top. The upper part of the loaded heap thus has a profile with spaced top triangles, forming peaks and valleys. Such heap shape needs to be leveled, i.e. flattened.

The blasting end 20 of the blasting pipe 16 is designed to be introduced in the heap of coal, in particular in a conical heap 25, as represented, and the device 10 is configured to discharge/emit one or more blasts of compressed air through the openings $\mathbf{22}_1$ and $\mathbf{22}_2$ into the heap of coal 25, in order to collapse the conical heap and hence cause a leveling of the heap of coal.

The second dotted line in FIG. 1 represents the upper surface profile 26 of the leveled heap of coal, after blasting. The coal heap in the coke oven chamber can thus be efficiently leveled by way of air/gas blasting, which can easily be operated at each charging hole of a coke oven.

Figure 5:
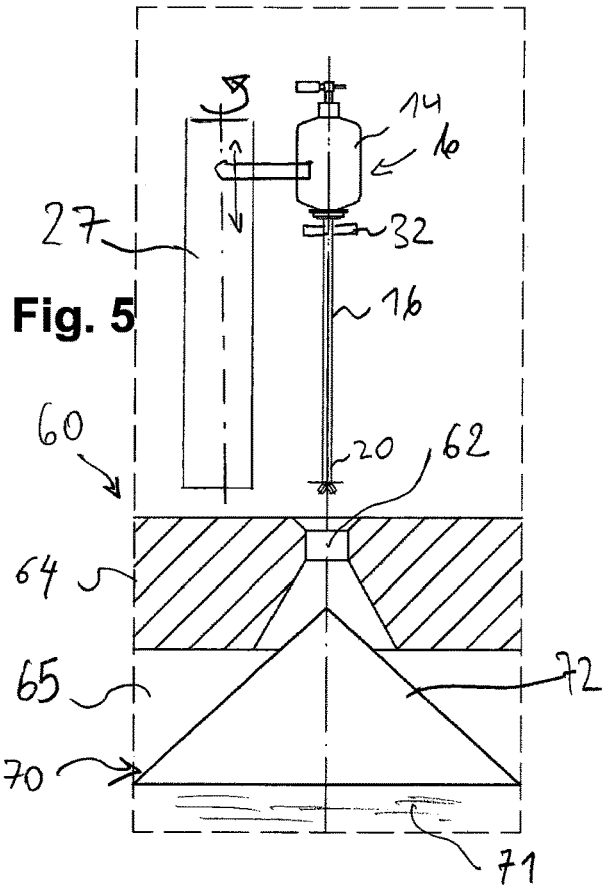
FIG. 5 to FIG. 8 are sketches illustrating the use of the present device for leveling heaps of coal in coke oven chambers.

It may be noticed that in practice, the device 10 is conveniently associated with a manipulator device, schematically represented at 27 in FIG. 5, that is typically configured to move the blowing pipe 16 between a rest position and a working position, in which said blasting end of said blasting pipe is positioned in a heap of coal. The design of the manipulator device requires mechanisms to at least move the blowing pipe 16, respectively the device 10, along the vertical direction, to introduce the blowing pipe into the heap of coal via the charging hole, and to remove it. Conveniently, the manipulator device is also configured to move the device 10 horizontally, to allow alignment with the charging hole and clearing the region above the charging hole. The construction of such manipulator is not the focus of the present disclosure and will therefore not be further described. Those skilled in the art may devise a variety of appropriate manipulator mechanisms based on hydraulic cylinders, toothed racks, etc.

It may however be noticed that in the present embodiment, the blasting pipe 16 is directly connected to the storage vessel 14, and the assembly of the blasting pipe 16 and storage vessel 14 is moved downward and upward as a whole. This may be different in other embodiments. The blasting pipe can be indirectly connected to the storage vessel, e.g. via intermediate piping. Also, in some cases it may be desirable to be able to manipulate the blasting pipe with respect to the storage vessel. The blasting pipe and/or the intermediate piping may include an articulation, designed to allow movement of the intermediate piping while ensuring fluid/gas communication between the storage vessel and the blasting pipe.

Preferably, the storage vessel 14 is configured as a conventional air blaster (or air/gas cannon). Accordingly, the storage vessel conventionally consists of a pressurized reservoir comprising a quick release valve with trigger mechanism (not visible in the drawing—inside vessel 14), that allows instantly releasing the compressed air contained in the storage vessel and thereby achieve a blast, called the impact force, that forms a kind of explosive spread of gas/air. The quick release valve (inside reservoir 14—not seen) is typically a fast opening, large surface valve arranged at the transition between the storage vessel and a blow-out tube. The quick release valve is selectively actuated by way of the trigger mechanism. In the shown embodiment, the blow out tube extends mainly inside the storage vessel 14 and protrudes shortly out of the storage vessel, ending with a flange 28. Blasting pipe 16 is fixed by its connection end 18 against flange 28, by a corresponding flange 31 surrounding the inlet 19. The blasting pipe 16 is thus in fluid communication with the blow-out tube, respectively the outlet 21, of the storage vessel 14. In other embodiments, the blow out tube and blasting pipe may be integral. Reference sign 29 indicates the inlet side of the storage vessel 14, comprising valving and piping with a pressurized gaz inlet port.

Such gas cannons are well known and any appropriate type of gas cannon may be used. For example, in the context of the disclosure one may use a VSR Blaster®, available from the company VSR Industrietechnik GmbH (Duisburg, Germany). The storage vessel may have a volume of 25 L, 50 L or above. The storage pressure of the gas contained in the storage vessel may be between 5 and 15 bar, in particular between 5 and 10 bar. In practice, the gas may be air, and it is convenient to connect the storage vessel 14 to the air network of the plant. Operation with gases other than air can be considered, e.g. with neutral gas, in particular nitrogen.

Also to be noted in FIG. 1 is a radial, tightening ring 32 surrounding the blasting pipe 16, which has an internal diameter matching that of the blasting pipe 16 and that can be slideably moved there along. This ring 32 is configured to form a cover cooperating with the inlet section of a charging hole 62 of a coke oven (see FIG. 6), in order to close the charging hole 62 through which the blasting pipe 16 is inserted when the device 10 is in position ready for blasting. The cover 32 thus advantageously allows tightly closing the charging hole 62 during the blasting of the heap, avoiding emission of fines outside from the coke oven chamber.

As visible in FIG. 1, the blasting end 20 of the blasting pipe 16 conveniently ends with a nozzle 40. In the shown embodiment, the nozzle 40 is a double blow nozzle, i.e. it comprises two discharge orifices $\mathbf{22}_1$, $\mathbf{22}_2$. The nozzle 40 is fixed at the tip of the blasting pipe 16, but could also be integral therewith.

Figure 2:
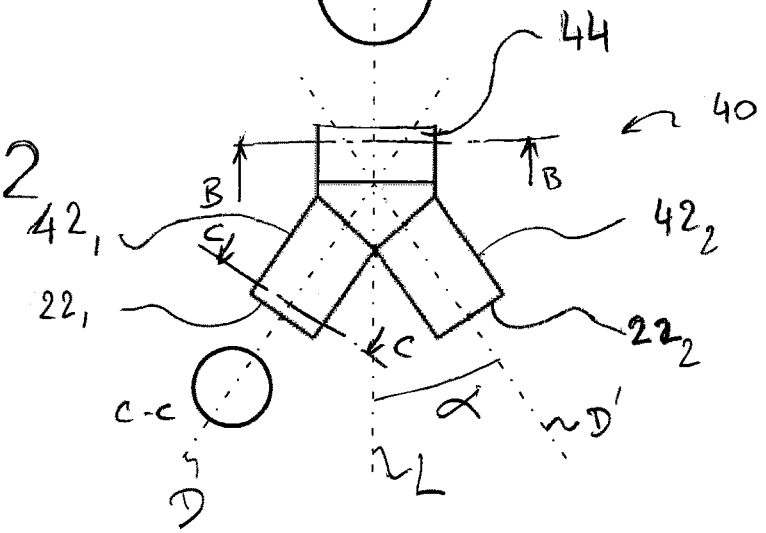
FIG. 2 is a detail view of the blasting end of the blasting pipe in FIG. 1.

As can be seen in more detail in FIG. 2, nozzle 40 has an inlet section 44 in axial continuation of the internal gas passage 23 of the blasting pipe 16, which communicates with two blow tubes $\mathbf{42}_1$ and $\mathbf{42}_2$ ending each with a respective blow orifice $\mathbf{22}_1$, $\mathbf{22}_2$. The inlet section 44 of nozzle 40 is of circular cross-section (section B-B). The two blow tubes $\mathbf{42}_1$ and $\mathbf{42}_2$ are straight and of circular cross-section; they extend along a respective axis D or D' that defines the blow direction. The blow tubes $\mathbf{42}_1$ and $\mathbf{42}_2$ are symmetric relative to the longitudinal axis L of the blasting pipe. In other words, the axis D, D' of each blow tube deviates from axis L by an angle α, whereby an angle 2α exists between the axes D and D' of the two blow tubes $\mathbf{42}_1$ and $\mathbf{42}_2$.

Nozzle 40 is thus designed to emit gas blasts ahead of the blasting pipe and to the side according to angle α. The angle α may be selected in the range from 20° to 90°, preferably between 35 and 90°. In particular, angle α may be equal to 35°, 45°, 60° and 90°. In the embodiment shown in FIG. 2, α=35°.

Figure 3:
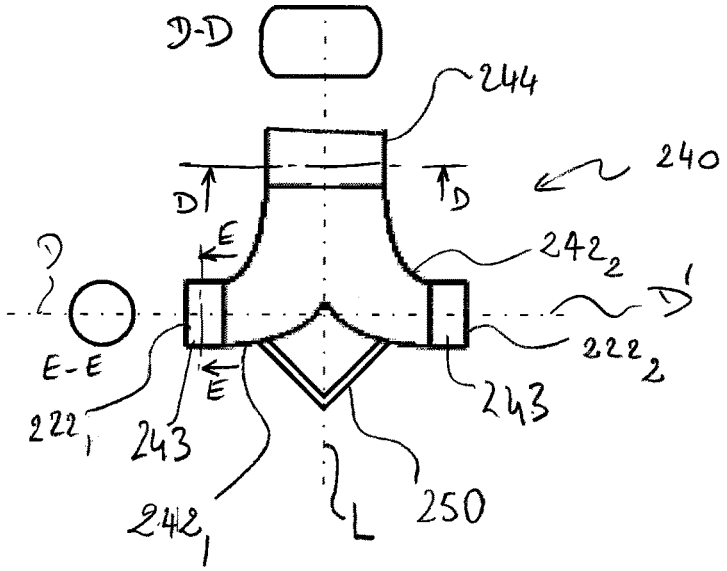

Turning to FIG. 3, an alternative nozzle design is shown. The nozzle 240 comprises an inlet section in fluid communication with the blasting pipe 16 and in axial continuation therewith. Here also the inlet stream divides into two blow tubes with respective orifices. As can be seen, blow tubes $\mathbf{242}_1$ and $\mathbf{242}_2$ comprise a curved tube section and end with a straight section 243 defining a blasting direction forming an angle of 90° (as indicated by axes D and D') with the axial direction L of the blasting pipe.

As can be seen in FIG. 3, in this variant the inlet section 244 preferably has a flattened cross-section (D-D) that matches the end portion of the blasting pipe (then of similar shape). The blow orifices $\mathbf{222}_1$ and $\mathbf{222}_2$ are however of circular cross-section, since they are defined by the straight sections 243 (of circular cross-section E-E).

Advantageously, a frontal guide 250 is mounted on the front side of the nozzle 240. The frontal guide 250 is a V-shaped metallic element. Its apex points away from the blow tubes 242 in axial direction L. Frontal guide 250 is designed to facilitate the introduction of the blasting pipe into the heap of coal.

In embodiments, the flow cross-section of the inlet pipe 144 and 244 is less than 200 $cm^2$, preferably between 50 $cm^2$ and 100 $cm^2$. The flow cross-section of the blow tubes $\mathbf{142}_2$ and $\mathbf{242}_2$ at their outlet is below 100 $cm^2$, preferably between 25 $cm^2$ and 50 $cm^2$.

Figure 4:
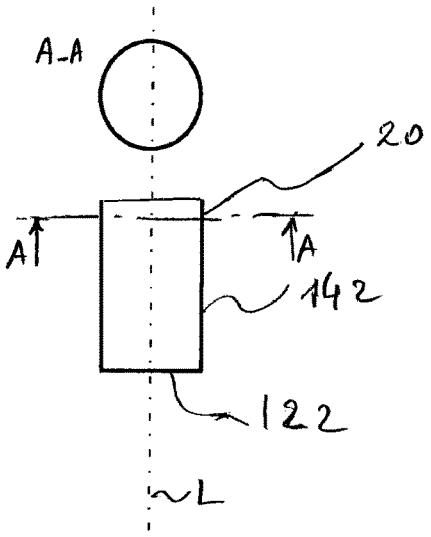
FIG. 3 and FIG. 4 are views of other possible nozzle designs.

FIG. 4 shows another design possibility, where the end portion of the blasting pipe itself forms the nozzle 142, with a single discharge orifice. The blasting pipe, of circular cross-section, is simply open in axial direction L at its tip: the discharge opening 122 is thus in a plane perpendicular to axis L. With such blasting nozzle 142, the blast is emitted uniquely ahead, i.e. in the axial direction L, of the blasting pipe 16. The cross-section of opening 122 may be less than 200 $cm^2$, and preferably comprised between 50 $cm^2$ and 100 $cm^2$.

It remains to be noted that in the presently shown embodiments, the blasting pipe 16 is a straight pipe. Depending on the design of the coke oven battery, the length of the blasting pipe may vary between 1 and 6 m, in particular with lengths about 2, 3, 4 or 5 m. The nominal diameter may be between 80 and 120 mm, in particular about 100 mm. In alternative embodiments, other shapes may be considered for the blasting pipe. The above mentioned dimensions are convenient for operation with conventional coke ovens, where the charging hole inlet section may have a diameter up to 500-600 mm. Accordingly, the cover ring 32 may have a corresponding outer diameter. These are only exemplary values and should not be construed as limiting.

FIG. 5 to FIG. 8 schematically illustrate one embodiment of the present method of charging a coke oven 60 with coal. The method is advantageously carried out using the above described device 10.

In FIG. 5, reference sign 60 generally designates a coke oven comprising a roof 64 and a coke oven chamber 65. As it will be understood, the figure shows only a part of the coke oven, below one charging hole 62. The coke oven chamber 65 will typically comprise several charging holes. Reference sign 70 generally designates a heap of coal. The coal has been loosely charged into the chamber 65, by gravity via the charging hole 62. The coal particles may typically be fine coal as conventionally used for blast/shaft furnaces. The coal may namely have a grain size below 10 mm, and even below 5 mm. For example, in a batch of coal loaded in the coke oven, a typical grain size distribution would comprise between 10 and 20 wt. % coal particle above 3.15 mm, and about 40 to 60 wt. % coal particles below 1 mm, with a majority in the 500 μm to 1 mm range. These are only exemplary values and should not be construed as limiting.

At the moment represented in FIG. 5, the step of charging the coke oven chamber with coal is finished. A heap of coal 70 has been formed in the chamber. It comprises base layer 71 of coal and a conical heap 72 (peaked pile) of coal, represented as a triangle, exists below each charging hole 62, typically laying over the base coal layer 71 (i.e. below triangle) as it is known to the skilled person and explained above. The device 10 is in a position ready for introduction into the coke oven, here referred to as rest position. The blasting pipe 16 is aligned vertically with the centre of the charging hole 62.

Figure 6:
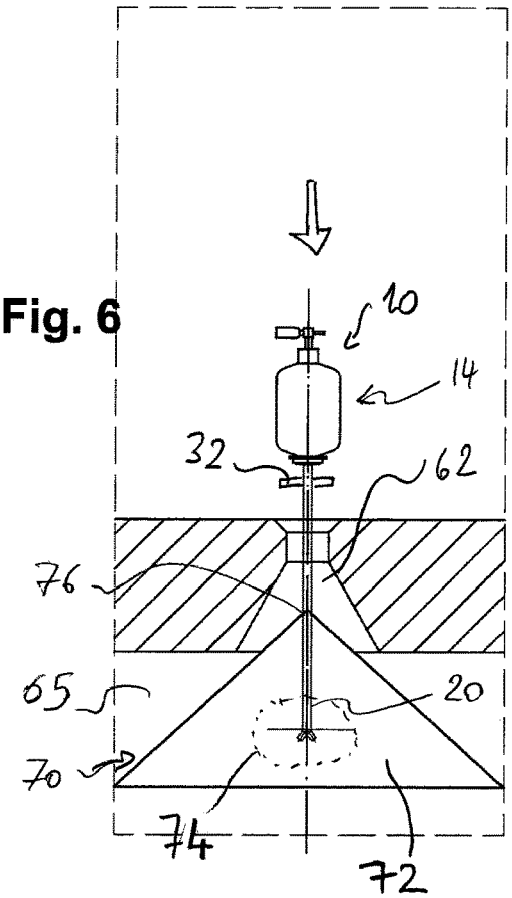
Figure 7:
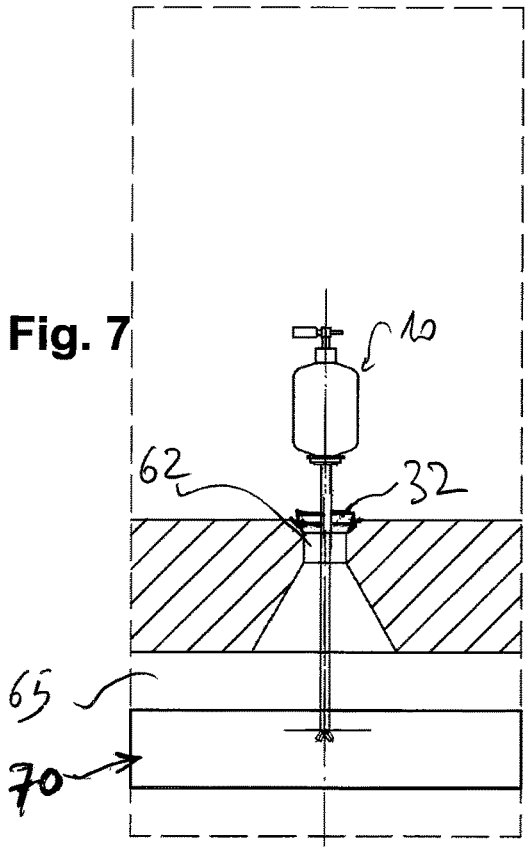

FIG. 6 illustrates a second step of the method: the device 10 is lowered into the coke oven chamber 65 in order to introduce the blasting end 20 of the blasting pipe 16 into the heap of coal 70, preferably to the center of the peaked pile of coal 70. This is simply done by a vertical movement of the device 10. The blasting end 20 with the discharge orifices is positioned in a region 74 underneath the apex 76 formed by the heap cone 72. The tip of blasting end 20, respectively the nozzle 40, may hence be submerged by a depth of at least 0.5 m, e.g. between 0.5 and 1.5 m, and preferably about 1 m, underneath the apex 76 of the heap cone. This is here referred to as the working position.

In the third step (shown in FIG. 7), one blast of compressed gas has been emitted through the blasting end 20 of the blasting pipe 16. The impact force has caused the triangular coal pile 72 to collapse, resulting in a leveling (flattening) of the coal heap 70 inside the coke oven chamber 65, as shown in the Figure. More than one blast may be released, if necessary.

One may note the cover 32 that has been slid along the blasting pipe 16 to be positioned at the entrance of the charging hole 62, in order to substantially close the latter during blasting and minimize emissions of dust into the atmosphere.

Figure 8:
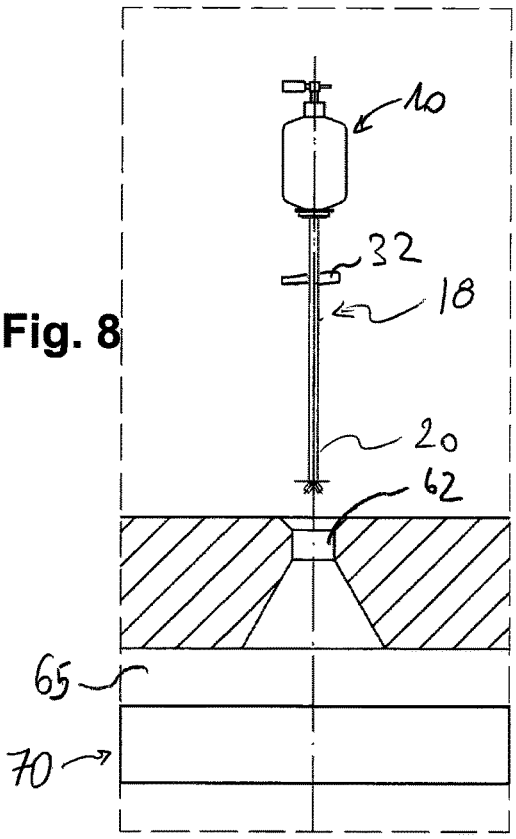

Finally, the device is moved upward in order to remove the blasting pipe 16 from the chamber 65, see FIG. 8.

The leveling procedure shown here with respect to FIGS. 5 to 8 is typically repeated for each single coked oven of the battery. For each coke oven, the operation is carried out for each charging hole, i.e. for each peaked pile formed during charging. The leveling can be carried sensibly out concurrently for each charging hole with a set of devices 10; or the same device 10 is used in each charging hole, one after another. With a properly designed gas blast system (blasting pipe as well pressurized storage vessel volume and pressure) it is possible to collapse a heap of coal with a single blast. The disclosure thus proves extremely efficient and expedient, which is of benefit for the overall coke oven management.

The invention claimed is:

1. Coke oven comprising:

at least one coke oven chamber having a roof; and a device for leveling a heap of coal, said device comprising:

a storage vessel having an outlet, said storage vessel being filled with a volume of pressurized gas and configured to instantly release said volume of pressurized gas through said outlet to create gas blasts;

a blasting pipe in fluid communication with said outlet, said blasting pipe having a connection port and a blasting end, said connection port being axially remote from said blasting end and being connected with said storage vessel;

at least one blasting opening at said blasting end of said blasting pipe through which a blast of compressed gas is released into a heap of coal, an impact force of the blast causing collapsing and leveling of the heap; and a manipulator configured for moving said blasting pipe, through said roof, between a rest position and a working position, in which said blasting end of said blasting pipe is positioned in a heap of coal.

2. Coke oven according to claim 1, wherein said blasting pipe is connected directly or indirectly to said storage vessel.

3. Coke oven according to claim 1, wherein the blasting pipe and the storage vessel are configured such that said blasting pipe can be moved relative to said storage vessel.

4. Coke oven according to claim 1, wherein the blasting end of the blasting pipe comprises a nozzle, wherein the nozzle includes at least one blasting orifice.

5. Coke oven according to claim 4, wherein the nozzle extends in the axial direction of the blasting pipe and the at least one blasting orifice is adapted to release gas blasts axially ahead of the blasting pipe.

6. Coke oven according to claim 4, wherein the nozzle comprises a pair of blow tubes each deviating by a predetermined angle ($\alpha$) from the axis of the blasting pipe for releasing blasts of compressed gas in two different directions.

7. Coke oven according to claim 6, wherein said predetermined deviating angle ($\alpha$) is between 20° and 90°.

8. Coke oven according to claim 6, wherein the blow tubes are straight tubes and define two blasting directions forming an angle of about 70° or 90°.

9. Coke oven according to claim 5, wherein the nozzle comprises a pair of blow tubes with curved portions, and first and second blasting orifices are aligned along opposite blasting directions, forming an angle of 180°.

10. Coke oven according to claim 6, wherein the nozzle further comprises a V-shaped frontal guide, the apex thereof pointing ahead of first and second nozzles in order to ease the introduction of the blasting pipe into the heap of coal.

11. Coke oven according to claim 1 further comprising a tightening ring that is configured to cooperate with a charging hole in said roof of said coke oven, in order to close said charging hole during blasting.

12. Coke oven according to claim 1, wherein the gas blast is released with a pressure between 5 and 10 bar.

* * * * *